US006682198B2

(12) United States Patent
Mangano

(10) Patent No.: US 6,682,198 B2
(45) Date of Patent: Jan. 27, 2004

(54) PORTABLE MIRROR

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 10/059,802

(22) Filed: Jan. 30, 2002

(65) Prior Publication Data

US 2003/0142424 A1 Jul. 31, 2003

(51) Int. Cl.[7] ..... G02B 5/08; G02B 5/10; G02B 7/182

(52) U.S. Cl. ..... 359/840; 359/850; 359/864; 359/871; 359/872; 248/469; 248/470; 248/472; 248/489; 248/492; 248/495; D6/300; D6/309; D6/310; D6/312; D6/313

(58) Field of Search ..... 350/840, 841, 350/850, 855, 864, 865, 869, 871, 872, 879, 880, 881, 882; 248/469, 470, 472, 473, 474, 489, 490, 492, 493, 495; D6/300, 301, 302, 309, 310, 311, 312, 313

(56) References Cited

U.S. PATENT DOCUMENTS

| | | | | |
|---|---|---|---|---|
| 956,274 | A | * | 4/1910 | Birdwell |
| 1,289,130 | A | * | 12/1918 | Duncan |
| 1,504,344 | A | * | 8/1924 | Hennigh |
| 1,989,437 | A | * | 1/1935 | Weisz |
| 2,071,243 | A | | 2/1937 | Tripp |
| 2,266,977 | A | | 12/1941 | Lynch |
| 2,324,049 | A | * | 7/1943 | Winslow |
| 3,474,555 | A | * | 10/1969 | McCaffrey |
| 3,596,627 | A | * | 8/1971 | Monk |
| 3,989,359 | A | * | 11/1976 | Shutt |
| 4,103,860 | A | * | 8/1978 | Haas et al. |
| 5,154,483 | A | | 10/1992 | Zeller |
| 5,452,140 | A | | 9/1995 | Kody |
| 5,604,633 | A | * | 2/1997 | Christianson |
| 5,953,157 | A | * | 9/1999 | Christianson |
| 6,099,133 | A | * | 8/2000 | Wright |
| 6,206,530 | B1 | | 3/2001 | Eberts |
| 6,217,180 | B1 | * | 4/2001 | Eisenbraum |
| 6,371,824 | B1 | * | 4/2002 | Brown |
| 6,476,984 | B1 | * | 11/2002 | Ringdahl |

FOREIGN PATENT DOCUMENTS

| | | | |
|---|---|---|---|
| DE | 3342959 A1 | * | 6/1984 |
| GB | 0521372 | * | 5/1940 |
| GB | 2246706 | * | 12/1992 |

* cited by examiner

*Primary Examiner*—Ricky D. Shafer
(74) *Attorney, Agent, or Firm*—Galgano & Burke

(57) ABSTRACT

A circular mirror has a frame with peripheral groove and a peripherally mounted gooseneck which is dimensioned to be wrapped around the periphery of the frame and received in the groove. According to the invention, the gooseneck is long enough so that it can be used to support the mirror in a variety of ways. For example, the gooseneck can be extended its full length with its end bent into a hook and then hung from a door. The gooseneck can also be bent into a semi-circle or similar configuration to be used as a table top stand.

23 Claims, 9 Drawing Sheets

PORTABLE MIRROR

BACKGROUND OF THE INVENTION

1. Field of the Invention

The invention relates to mirrors. More particularly, the invention relates to a portable mirror having a flexible supporting member.

2. State of the Art

Mirrors have been an indispensable part of human existence since as early as Greek mythology. Throughout the years many have sought to improve the nature an quality of mirrors for various purposes. One particular type of mirror which has received much attention is the portable mirror. For example, U.S. Pat. No. 1,989,437 to Weisz discloses two circular mirrors coupled to each other by a gooseneck cable. The cable can be disconnected from the mirrors and held in a channel with the two mirrors face-to-face for compact storage. While this may have been an advance in 1934, the Weisz mirror assembly requires disassembly in order to be compact. Moreover, the Weisz mirror assembly is only suited for mounting on a table top. Further, the Weisz mirror assembly is limited in that the length of the gooseneck must be no longer than the circumference of the mirror.

Much attention has been given to the wearable mirror. For example, U.S. Pat. No. 2,071,243 to Tripp, U.S. Pat. No. 2,324,049 to Winslow, and U.S. Pat. No. 6,099,133 to Wright each disclose a mirror which is hung around the neck and supported by the chest. While this type of mirror may be useful in some instances, it is limited in its application. In addition, these mirrors tend to be very bulky.

While table top and wearable mirrors have received much attention in the patent literature, portable hanging mirrors have received some attention. U.S. Pat. No. 5,452,140 to Kody discloses a portable mirror which can be hung from a door or a ledge. Kody's mirror assembly includes a flexible strap with weights at one end and VELCRO along at least a portion of its surface. A small oval mirror is provided with mating VELCRO on its back. The strap is draped over the top of a door, for example, with the weights near the top of the door, and the mirror is fastened to the strap via the VELCRO. While this assembly works reasonably well, it is limited to one application. In addition, it requires assembly and disassembly.

SUMMARY OF THE INVENTION

It is therefore an object of the invention to provide a portable mirror.

It is also an object of the invention to provide a portable mirror which is compact.

It is another object of the invention to provide a portable mirror which is easy to use.

It is still another object of the invention to provide a portable mirror which does not require assembly or disassembly.

It is jet another object of the invention to provide a mirror which is suitable for hanging and table top use.

In accord with these objects which will be discussed in detail below, a presently preferred embodiment of the present invention includes a circular mirror having a frame with peripheral groove and a peripherally mounted gooseneck which is dimensioned to be wrapped around the periphery of the frame and received in the groove. According to the invention, the gooseneck is long enough so that it can be used to support the mirror in a variety of ways. For example, the gooseneck can be extended its full length with its end bent into a hook and then hung from a door. The gooseneck can also be bent into a semi-circle or similar configuration to be used as a table top stand.

The tremendous versatility of the mirror according to the invention allows it to be used effectively in a great number of environments, for example in showers, in dorm rooms, in lockers, in hotel rooms, in bathrooms, etc. The gooseneck is flexible enough so it can assume any shape and then completely wrap around the perimeter of the mirror for compact storage. Nevertheless, the gooseneck is stiff enough that it can support the mirror.

According to the presently preferred embodiment, the mirror is approximately seven inches in diameter and the gooseneck is approximately twenty-five inches long. The mirror frame is preferably metallic, either brass or chrome colored and the gooseneck is preferably the same color as the frame. The mirror is preferably sold together with a soft pouch which is dimensioned to hold the mirror with the gooseneck fully wrapped around the mirror in the peripheral groove.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
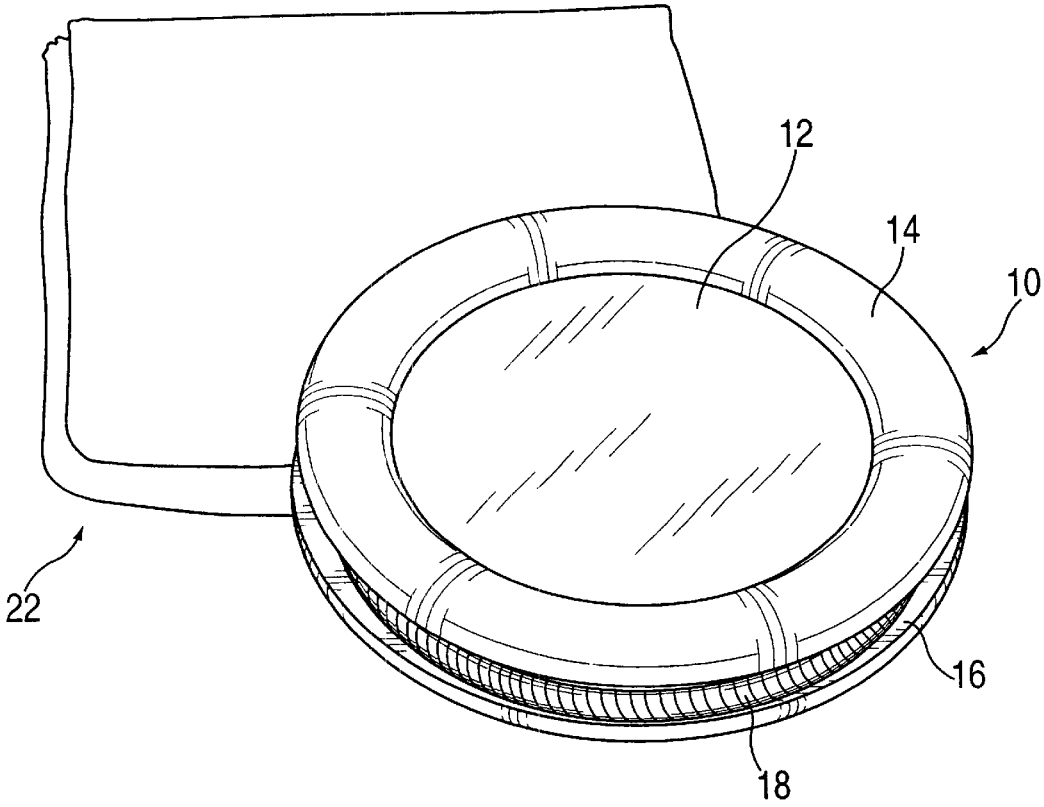
FIG. 1 is a perspective view of a mirror according to the invention with the gooseneck wrapped around the mirror in its peripheral groove, and pictured with a protective pouch.

Referring now to the Figures, a portable mirror 10 according to the invention includes a circular reflector 12 mounted in a circular frame 14. The frame 14 has a peripheral groove 16 and a gooseneck 18 is peripherally mounted to the frame 14 such that it can be wrapped around the frame 14 and received in the groove 16. The free end of the gooseneck 18 is preferably provided with a blunt cap 20. As shown in FIG. 1, the mirror 10 is preferably packaged with a soft protective pouch 22.

According to the presently preferred embodiment, the reflector 12 is a glass mirror and the frame 14 is metallic with either a brass or chrome finish. The gooseneck 18 preferably has the same finish as the frame 14.

Figure 2:
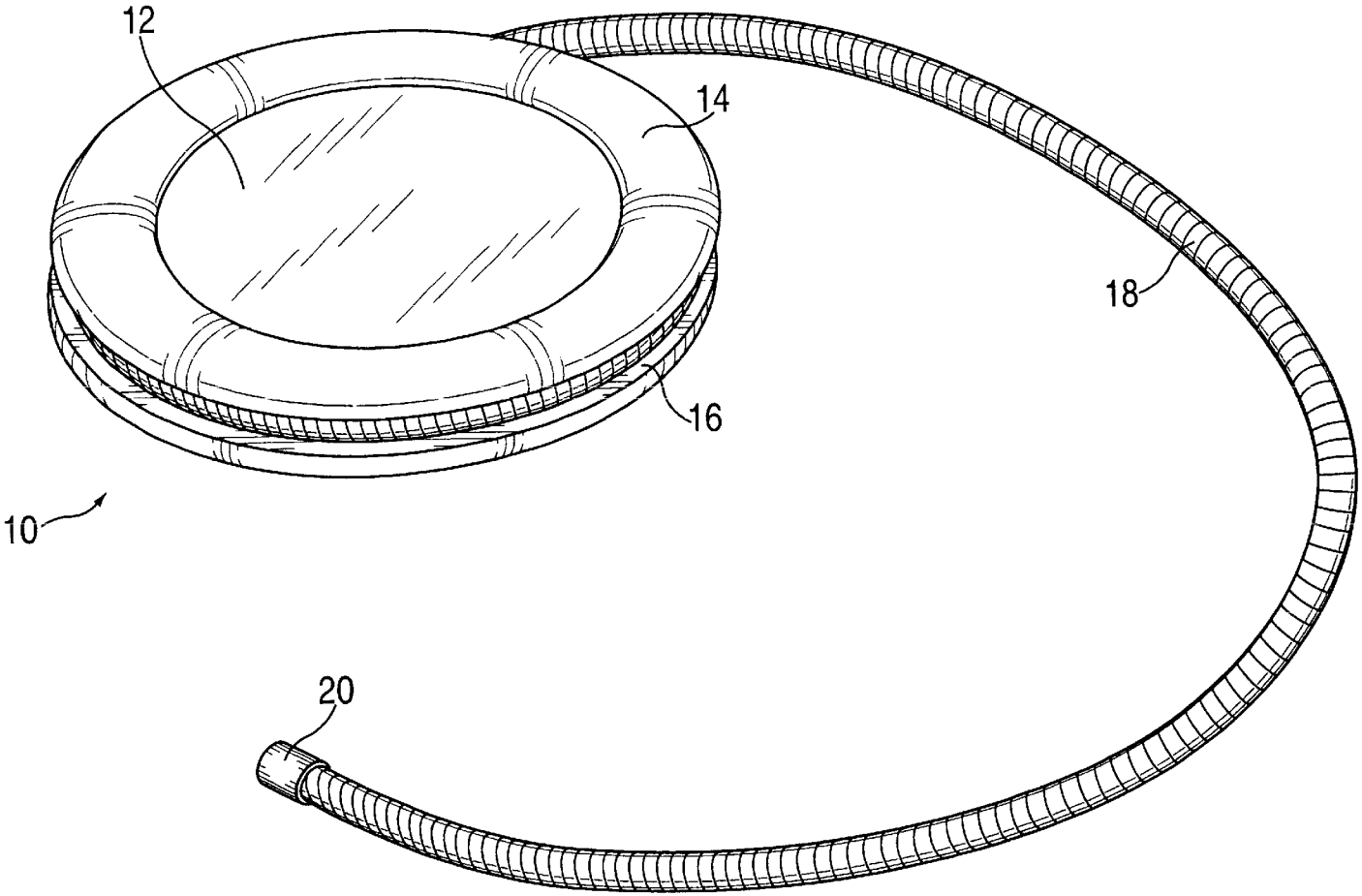
FIG. 2 is a perspective view of the mirror lying flat on a surface with the gooseneck partially uncoiled.
Figure 6:
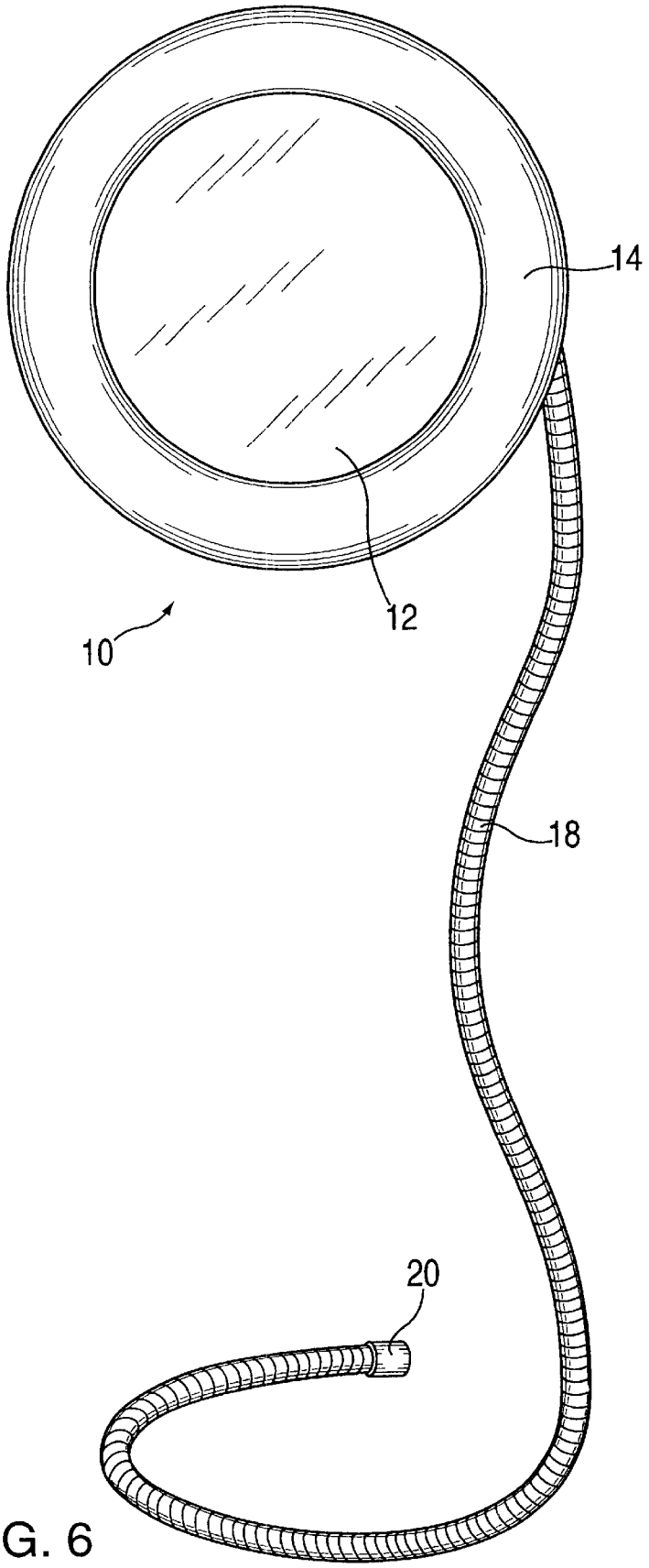
FIG. 6 is a view similar to FIG. 5 but with the gooseneck still further uncoiled so that the mirror is supported significantly higher above the surface.
Figure 7:
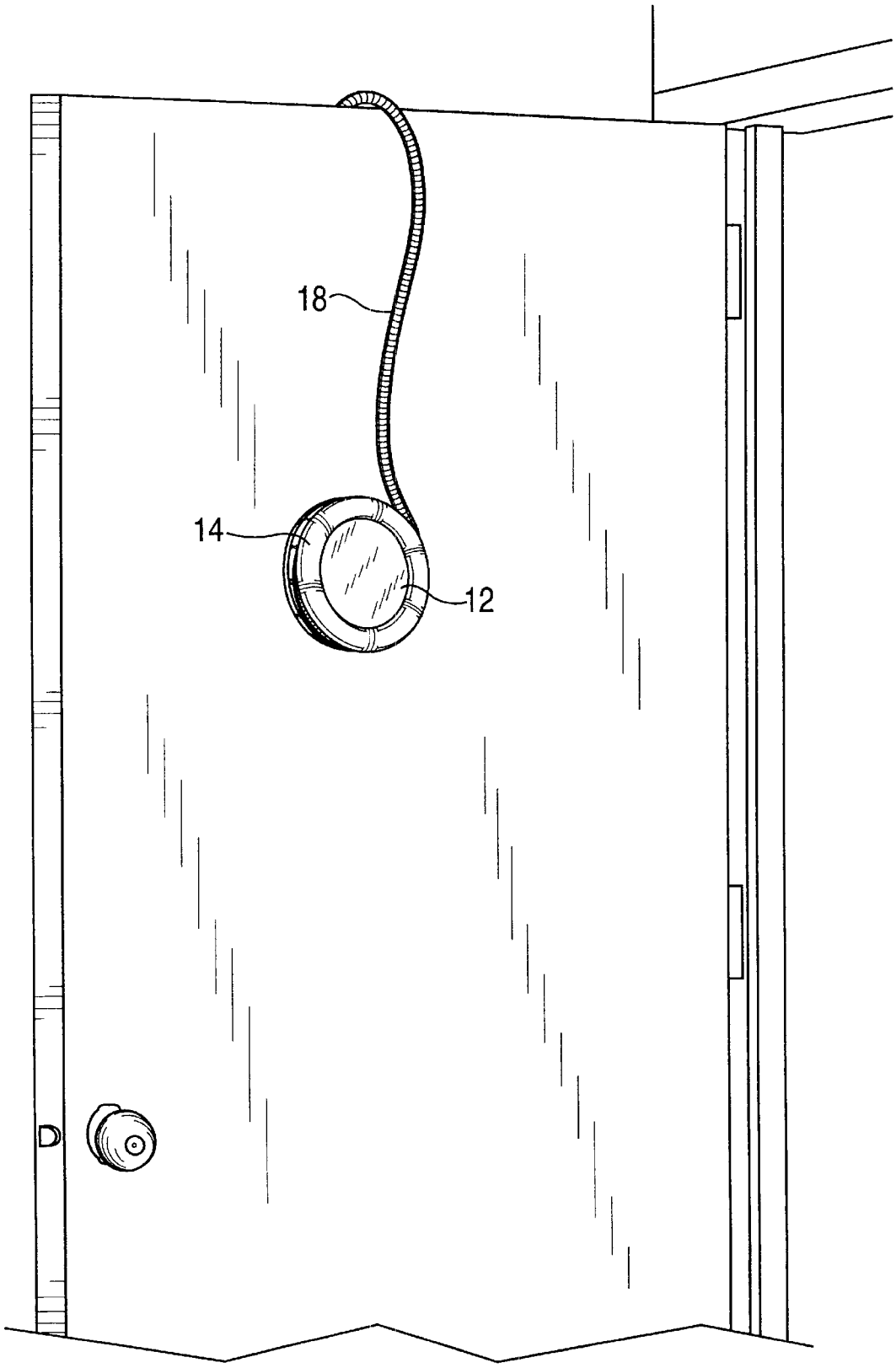
FIG. 7 is a plan view showing the mirror hanging from a door.

As seen best in FIGS. 2, 6, and 7, the gooseneck 18 is preferably longer than the circumference of the frame 14. This allows the gooseneck 18 to be uncoiled and bent into a number of different configurations. According to the presently preferred embodiment, the mirror frame is approximately seven inches in diameter and the gooseneck is approximately twenty-five inches long.

Figure 3:
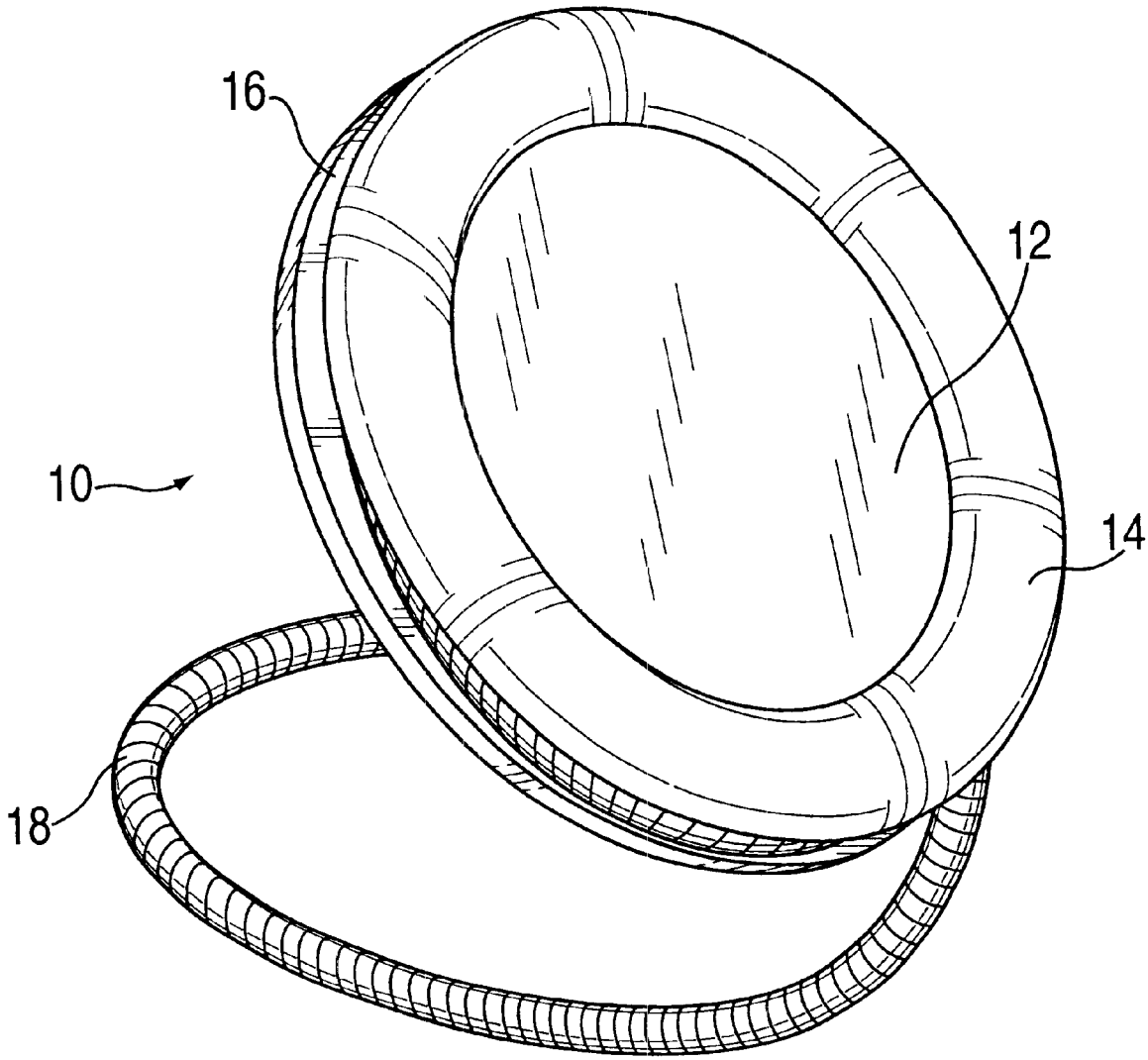
FIG. 3 is a perspective view of the mirror with the gooseneck coiled into a base supporting the mirror on a surface.
Figure 4:
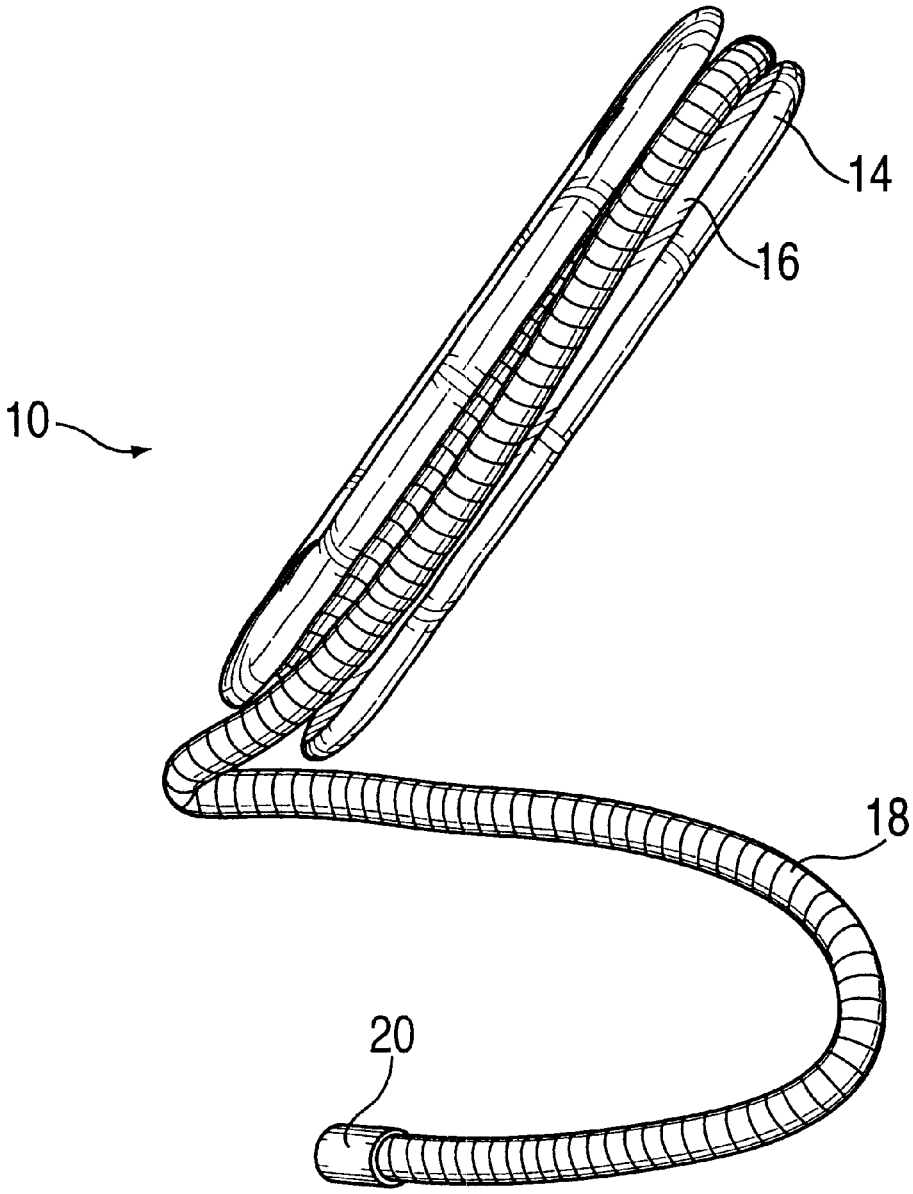
FIG. 4 is a side perspective view of the mirror in substantially the same configuration as FIG. 3.

As shown in FIGS. 3 and 4, when the gooseneck 18 is partially uncoiled and bent into a semi-circle, the mirror frame 14 can be supported on a surface with the reflector 12 at an angle to the surface.

Figure 5:
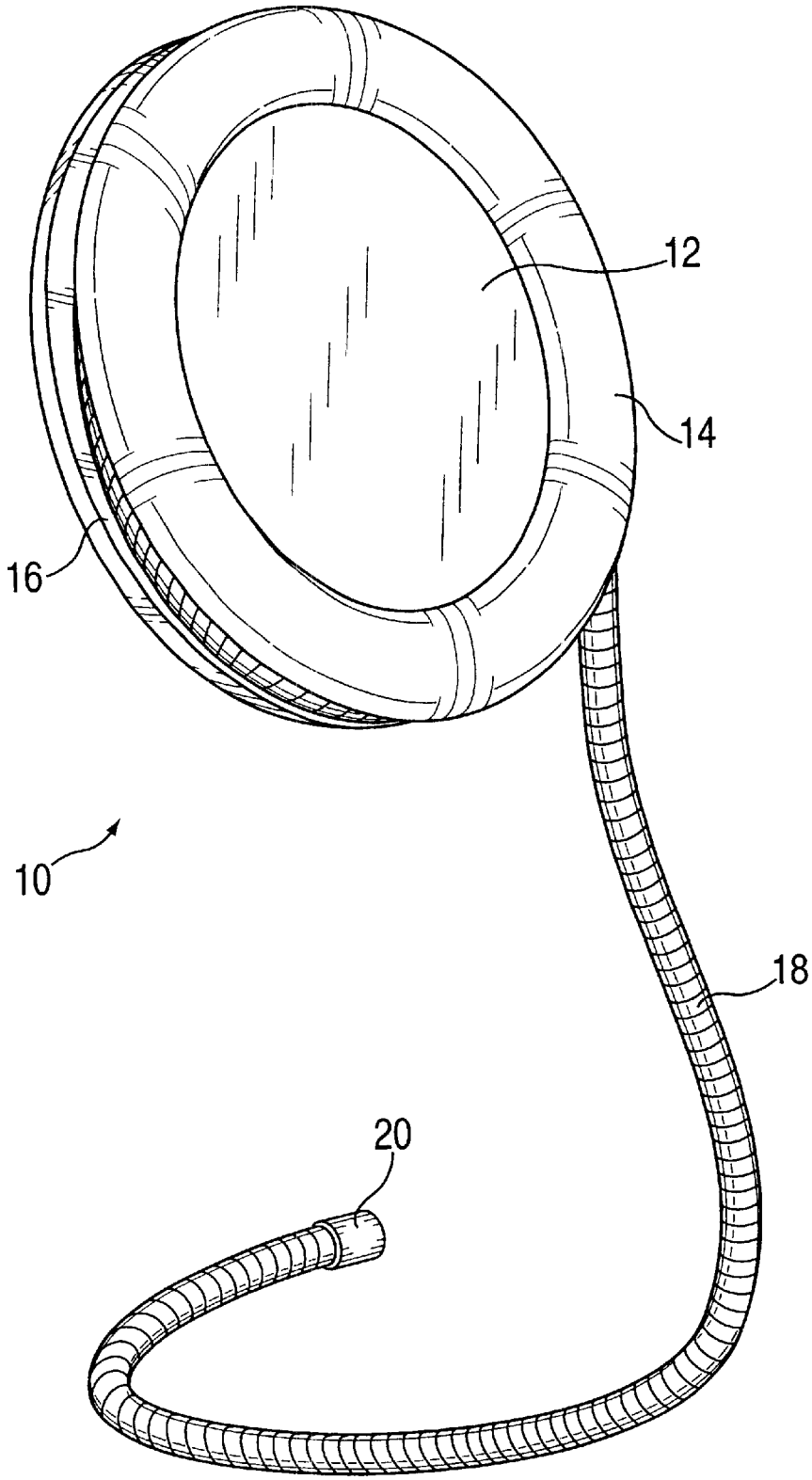
FIG. 5 is a view similar to FIG. 3 but with the gooseneck further uncoiled so that the mirror is supported higher above the surface.

As seen in FIGS. 5 and 6, further uncoiling of the gooseneck 18 permits the reflector 12 to be supported a distance above the surface.

FIG. 7 shows the mirror hanging from a door with the gooseneck 18 hooked over the top of the door.

Figure 8:
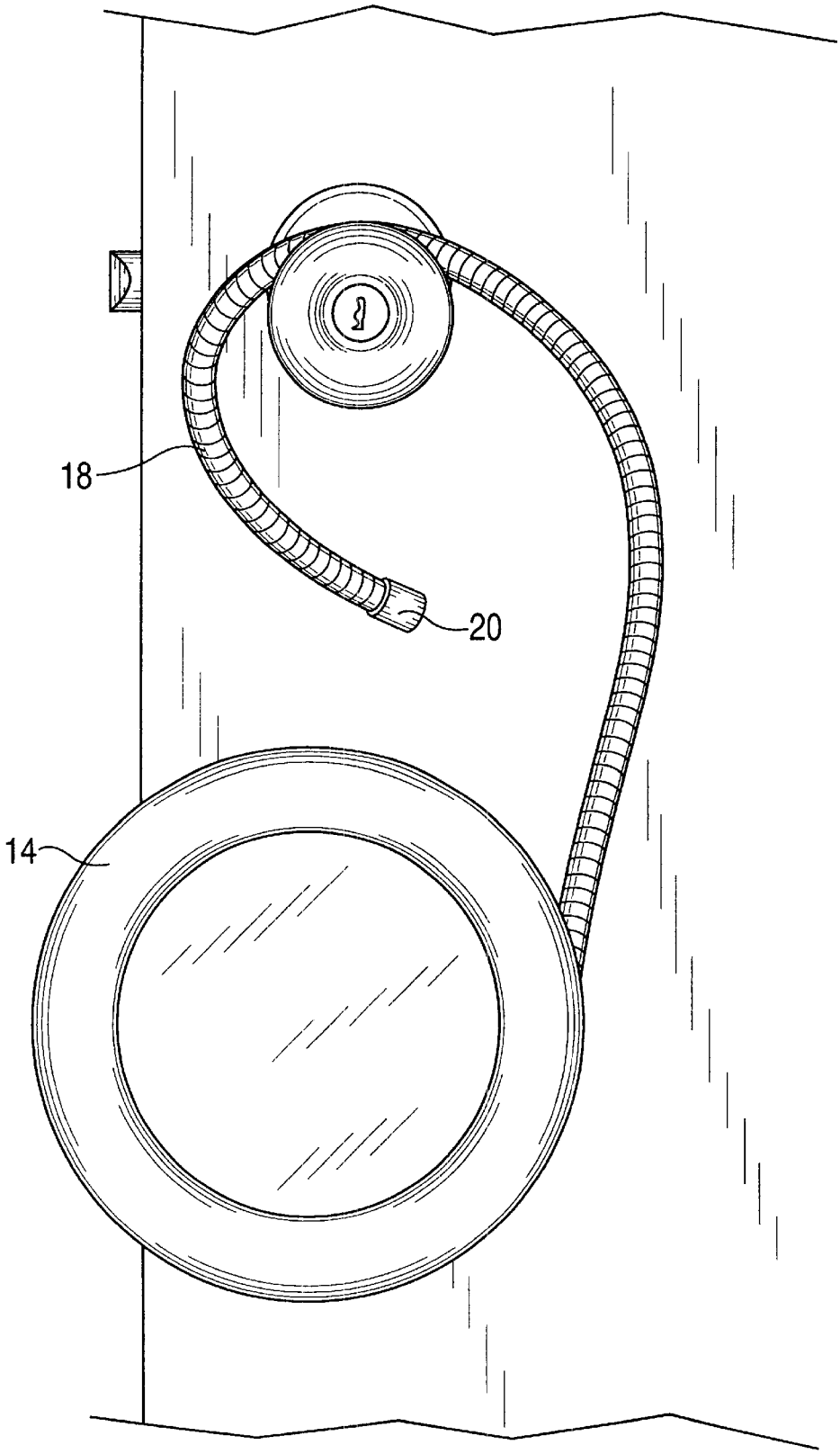
FIG. 8 is a plan view illustrating the mirror hanging from a door knob.
Figure 9:
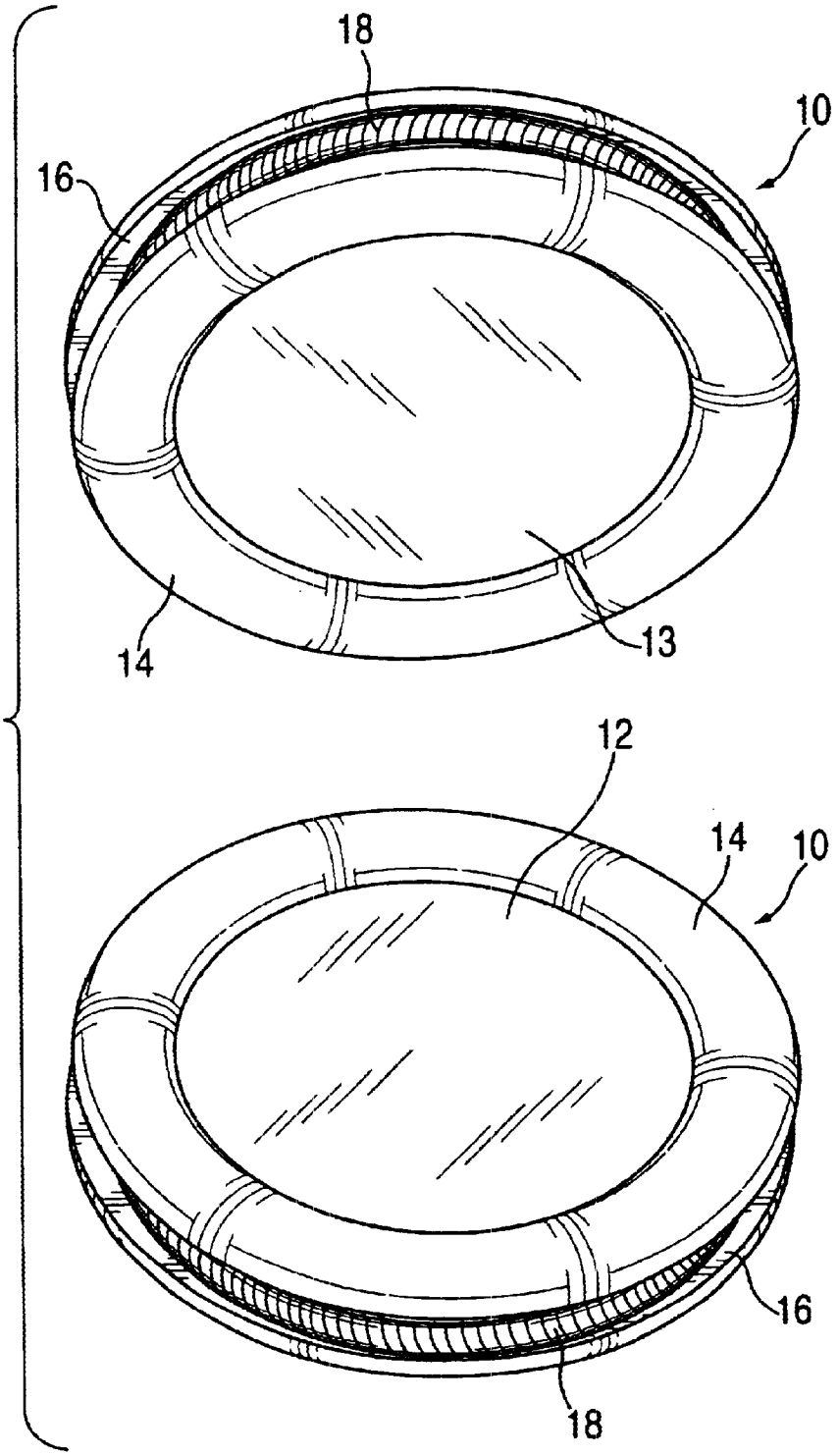
FIG. 9 illustrates front and rear perspective views of the mirror.

FIG. 8 illustrates how the gooseneck 18 can be used to support the mirror a short distance from a door knob.

As shown in FIGS. 1–9, the mirror is preferably double sided with a normal mirror 12 on one side and a 5X magnifying mirror 13 on the other side.

There has been described and illustrated herein a portable mirror. While a presently preferred embodiment of the invention has been described, it is not intended that the invention be limited thereto, as it is intended that the invention be as broad in scope as the art will allow and that the specification be read likewise. Thus, while a circular mirror and circular frame has been disclosed, it will be appreciated that other shapes could be utilized. For example, the mirror and frame could be oval or could be shaped like a polygon. It will be appreciated that if the mirror and frame are shaped like a polygon, it is preferably a many sided polygon in order for the gooseneck to wrap around the mirror smoothly. Alternatively, the mirror frame could assume any shape provided that the groove for receiving the gooseneck approximates a circle on its interior. Also, while the mirror frame has been described as metallic, it will be appreciated that other materials such as plastic or wood could be used. Further, while the preferred embodiment utilizes a glass reflector, a less expensive metallic reflector could be used. The gooseneck is of conventional construction and is preferably made of metal and is of sufficient flexibility or resiliency to allow it to bend to form a variety of configurations, yet it is of sufficient rigidity to maintain the intended bent shape and support the mirror in its desired position. It will therefore be appreciated by those skilled in the art that yet other modifications could be made to the provided invention without deviating from its spirit and scope as so claimed.

What is claimed is:

1. A portable mirror, comprising:

a) a generally planar frame having a front face, a rear face and a peripheral edge defining the outer perimeter of said frame, said peripheral edge having a peripheral groove extending substantially along the length of said peripheral edge;

b) a reflector mounted on said front face of said frame;

c) a gooseneck peripherally coupled to said frame and movable between a storage position, in which at least a substantial length of said gooseneck is received within said peripheral groove, and a use position, in which said gooseneck is at least partially uncoiled and withdrawn from said peripheral groove so that it can be used to support the frame in a desired orientation, wherein said gooseneck is of sufficient flexibility so that, in its use position, it can assume a variety of orientations and said gooseneck is also of sufficient rigidity so that it can support the frame in said variety of orientations.

2. A portable mirror according to claim 1, wherein: said frame is substantially circular.

3. A portable mirror according to claim 2, wherein: said reflector is substantially circular.

4. A portable mirror according to claim 2, wherein: said frame is approximately seven inches in diameter.

5. A portable mirror according to claim 4, wherein: said gooseneck is approximately twenty-five inches long.

6. A portable mirror according to claim 1, wherein: said reflector is a glass mirror.

7. A portable mirror according to claim 1, wherein: said frame is metallic.

8. A portable mirror according to claim 1, wherein: said frame is plastic.

9. A portable mirror according to claim 1, wherein: said frame is wooden.

10. A portable mirror according to claim 1, wherein: said gooseneck has a free end covered with a blunt cap.

11. A portable mirror according to claim 1, further comprising:

d) a second reflector mounted on said rear face of said frame, said second reflector being a magnifying mirror.

12. The mirror according to claim 1, wherein said frame has a generally circular disc shape.

13. The mirror according to claim 1, wherein said peripheral groove extends along the entire length of said peripheral edge.

14. The mirror according to claim 1, wherein said reflector is circular.

15. The mirror according to claim 1, wherein a reflector is mounted on said rear face of frame.

16. The mirror according to claim 15, wherein said reflector mounted on said rear face is circular.

17. The mirror according to claim 16, wherein said reflector on said rear face is a magnifying mirror.

18. The mirror according to claim 1, wherein said gooseneck has a length greater than the length of said peripheral groove.

19. The mirror according to claim 18, wherein said peripheral groove is configured and dimensioned to allow said gooseneck to be received entirely within said groove when in said storage position thereof.

20. The mirror according to claim 1, wherein said gooseneck is of a sufficient length such that, in its use position, it permits the frame to be supported on a surface with said reflector at an angle to the surface.

21. The mirror according to claim 20, wherein said gooseneck is of a sufficient length such that, in its use position, it permits the frame to be supported a distance above the surface.

22. A method for supporting a mirror on a surface, comprising:

a) providing a portable mirror comprising a generally planar frame having a front face, a rear face and a peripheral edge defining the outer perimeter of said frame, said peripheral edge having a peripheral groove extending substantially along the length of said peripheral edge; a reflector mounted on said front face of said frame; a gooseneck peripherally coupled to said frame and movable between a storage position, in which at least a substantial length of said gooseneck is received within said peripheral groove, and a use position, in which said gooseneck is at least partially uncoiled and withdrawn from said peripheral groove so that it can be used to support the frame in a desired orientation, wherein said gooseneck is of sufficient flexibility so that, in its use position, it can assume a variety of orientations and said gooseneck is also of sufficient rigidity so that it can support the frame in said variety of orientations;

b) bending a portion of the gooseneck into a substantially semi-circular configuration; and c) placing the bent portion of the gooseneck on a surface such that the gooseneck supports the mirror frame on the surface.

23. A method for temporarily hanging a mirror, comprising:

a) providing a portable mirror comprising a generally planar frame having a front face, a rear face and a peripheral edge defining the outer perimeter of said frame, said peripheral edge having a peripheral groove extending substantially along the length of said peripheral edge; a reflector mounted on said front face of said frame; a gooseneck peripherally coupled to said frame and movable between a storage position, in which at least a substantial length of said gooseneck is received within said peripheral groove, and a use position, in which said gooseneck is at least partially uncoiled and withdrawn from said peripheral groove so that it can be used to support the frame in a desired orientation, wherein said gooseneck is of sufficient flexibility so that, in its use position, it can assume a variety of orientations and said gooseneck is also of sufficient rigidity so that it can support the frame in said variety of orientations;

b) bending a portion of the gooseneck into a substantially hook-shaped configuration; and c) hanging the mirror from an object using the bent portion of the gooseneck.

* * * * *